United States Patent [19]

Koike et al.

[11] Patent Number: 5,018,655

[45] Date of Patent: May 28, 1991

[54] PAPER FEED DEVICE FOR PRINTER

[75] Inventors: Yasushi Koike; Akio Tajima, both of Tokyo, Japan

[73] Assignee: Seikosha Co., Ltd., Tokyo, Japan

[21] Appl. No.: 436,288

[22] Filed: Nov. 14, 1989

[30] Foreign Application Priority Data

Nov. 15, 1988 [JP] Japan ..... 63-148874[U]

[51] Int. Cl.[5] ..... B41J 11/50; B41J 13/054

[52] U.S. Cl. ..... 226/101; 400/605; 400/636.3; 400/637.6

[58] Field of Search ..... 226/101; 400/605, 636.3, 400/637, 637.5, 637.6

[56] References Cited

U.S. PATENT DOCUMENTS 4,564,305 1/1986 Rekewitz et al. ..... 400/636.6 X
4,607,968 8/1986 Carena ..... 400/637 X
4,611,939 9/1986 Fujiwara ..... 400/636.3 X
4,909,497 3/1990 Itabashi et al. ..... 400/605 X

*Primary Examiner*—Daniel P. Stodola
*Assistant Examiner*—Paul Bowen
*Attorney, Agent, or Firm*—Jordan and Hamburg

[57] ABSTRACT

A paper feed for a printer includes a frame, a platen rotatably mounted on the frame, a friction roller support juxtaposed to the platen, a spring mounted on the frame and having a first operable condition biasing the friction roller support toward the platen with a first biasing force and having a second operable condition biasing the friction roller support toward the platen with a second biasing force less than the first biasing force, and a cam rotatably mounted on the frame and operable between first and second operable positions to effect disposition of the spring in said first and second operating conditions.

11 Claims, 2 Drawing Sheets

PAPER FEED DEVICE FOR PRINTER

BACKGROUND OF THE INVENTION

This invention relates to a paper feed device for a printer, for example, provided with both a tractor feed mechanism and a friction feed mechanism serving as paper feed means.

In conventional printers equipped with a tractor feed mechanism and a friction feed mechanism, there is also provided a mechanism for changing the resilient contacting force of a friction roller with a platen in accordance with the mode of paper feed. With this changing mechanism, the friction roller is forced to resiliently contact the platen strongly in a friction feed mode and weakly in a tractor feed mode. For example, Japanese Patent Application No. 60-243323, filed by the present applicant, discloses a mechanism for changing the resilient contacting force of a friction roller with a platen, wherein there is disclosed a cam having a complicated shape, a cam follower, several levers, and a biasing spring.

Such a mechanism is used to control the frictional force between a recording paper and the platen for a tractor feed mode and a friction feed mode. However, this conventional arrangement is complicated in structure, requires a long assembly time, and can hardly set the frictional force between the recording paper and the platen to a proper level in accordance with the mode of paper feed.

Accordingly, it is an object of the present invention to make it easy to set the frictional force between a recording paper and a platen to a proper level for a tractor feed mode and for a friction feed mode using a simplified structure, and to improve the efficiency of assembly.

SUMMARY OF THE INVENTION

To achieve the foregoing object, a paper feed device according to the present invention comprises a friction roller in resilient contact with the outer surface of a platen, a movably mounted supporting member disposed at the outer surface of the platen for rotatably supporting the friction roller, a biasing spring for urging the friction roller toward the platen via the supporting member, the biasing spring having tongue portions connected to leg portions of the supporting member and the portion of the spring which excludes the tongue portions is contactable with contacting portions of the supporting member, and rotatable cam means are provided which have a first rotational position engageable with the biasing spring to separate the contacting portions of the supporting member from the biasing spring, and a second rotational position disengageable from the biasing spring to allow the biasing spring to contact the contacting portions.

At the first rotational position, the cam means separates the contacting portions of the supporting member from the biasing spring so that the friction roller is pressed against the platen by the weaker spring force of only the tongue portions. At the second rotational position, the cam means brings the contacting portions of the supporting member into contact with the biasing spring so that the friction roller is pressed against the platen by the stronger spring force of the whole biasing spring.

BRIEF DESCRIPTION OF THE DRAWINGS

The drawings show an embodiment of the present invention in which.

DESCRIPTION OF THE PREFERRED EMBODIMENTS

An embodiment of the present invention will now be described with reference to the drawings.

Figure 1:
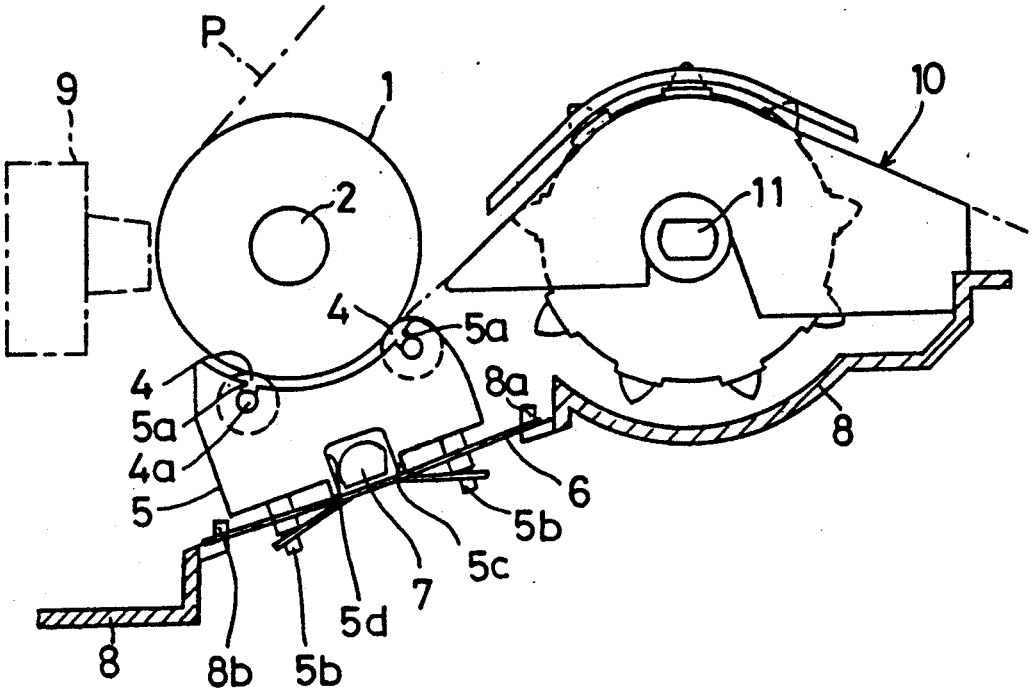
FIG. 1 is a front view in a friction feed mode.

As shown in FIG. 1, a platen 1 is secured to a shaft 2 whose both end portions are rotatably supported on opposite side plates 3 (shown in FIG. 2) which are spaced from each other. Friction rollers 4 are held in resilient contact with a lower portion of the outer surface of the platen 1. A supporting member 5 is movable in a direction facing the outer surface of the platen 1. The friction rollers 4 are rotatably supported on the supporting member 5. The upper surface of the supporting member 5 is formed with U-shaped grooves 5*a* for rotatably receiving the shafts 4*a* of the friction rollers 4.

The bottom surface of the supporting member 5 has leg portions 5*b* which are connected with a biasing spring 6, hereinafter described in greater detail, and contacting portions 5*c* which are contactable with the biasing spring 6. The supporting member 5 is formed with a recess portion 5*d* through which a cam means 7 passes. The length of the leg portions 5*b* is longer than the length of the contacting portions 5*c*.

Figure 4:
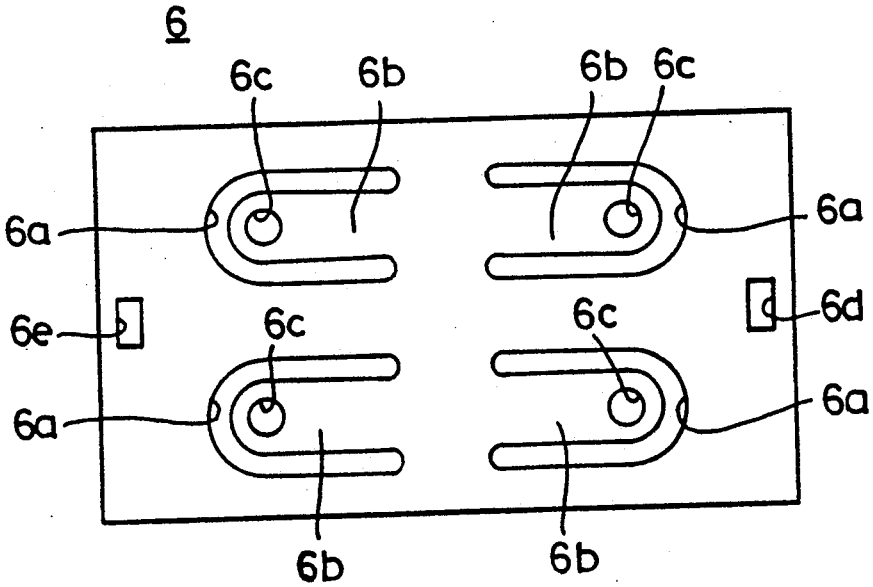
FIG. 4 is an enlarged plan view of a biasing spring.

The biasing spring 6 is a leaf spring which urges the friction rollers 4 toward the platen 1 via the supporting member 5 Specifically, as shown in FIG. 4, the biasing spring 6 is formed with four U-shaped slits 6*a*, each of which forms a tongue portion 6*b*. A distal end portion of each tongue portion 6*b* has a coupling hole 6*c* fitable with the leg portion 5*b*. The biasing spring 6 has engaging holes 6*d*, 6*e* at both of its end portions so that by engaging these engaging holes 6*d*, 6*e* with protrusions 8*a* 8*b* of a baseplate 8, the biasing spring 6 is supported in place. The contacting portions 5*c* are adapted to contact surface portions except for the tongue portions 6*b*, of the biasing spring 6.

The cam means 7 extends across and over the biasing spring 6 (in the top-to-bottom direction in FIG. 4) and passes through a recess portion 5*d* of the supporting member 5. The cam means 7 is shaped like a rod and is rotatably supported by the side plates 3 (shown in FIG. 2) via shafts 7*c* formed at both of its end portions. The cam means 7 is formed with a first cam surface 7*a* and a second cam surface 7*b*. The first cam surface 7*a* is a flat cam surface spaced further from the center of rotation of the cam means 7, and is operable to engage the biasing spring 6 to separate the contacting portions 5*c* of the supporting member 5 from the biasing spring 6 when the cam means 7 is at a first rotational position. The second cam surface 7*b* is another flat cam surface whose distance from the center of rotation of the cam means 7 is less than that of the first cam surface 7*a*, and disengages from the biasing spring 6 to allow the biasing spring 6 to contact the contacting portions 5*c* when the cam means 7 is at a second rotational position.

A print head 9 is mounted on a carriage not shown in the drawings in confronting relation to the platen 1, and a tractor device 10 is provided on the opposite side of the print head 9. The tractor device 10 is relatively non-rotatably but axially shiftably fitted on a shaft 11 whose both end portions are rotatably supported by the side plates 3. Reference symbol P designates a recording paper.

Figure 2:
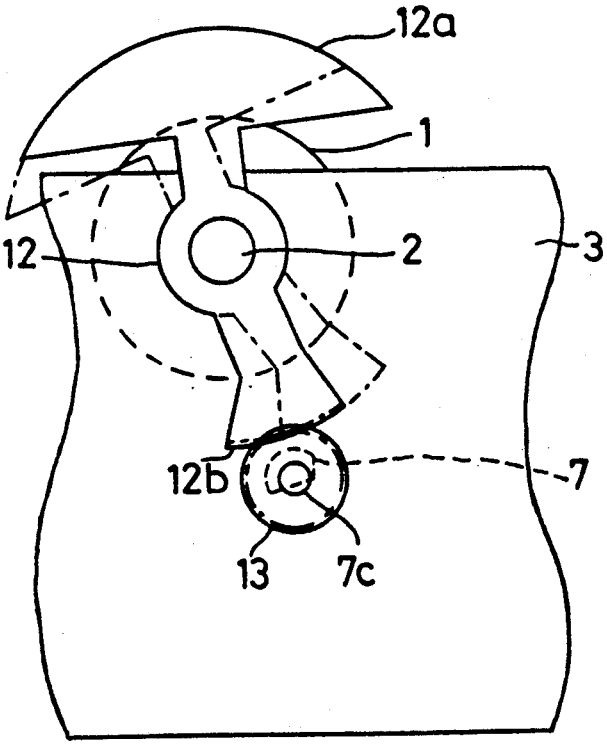
FIG. 2 is a front view of a rotating mechanism for the cam means.

FIG. 2 shows a mechanism for rotating the cam means 7 for switching between a friction feed mode and a tractor feed mode. Specifically, a distal end portion of the shaft 2 of the platen 1 and a distal end portion of the shaft 7*c* of the cam means 7 project outwardly from the side plate 3. The projecting end of the shaft 2 swingably supports an operation lever 12. One end portion of the operation lever 12 has an operating portion 12*a* which can be operated from outside, and the other end portion is formed with a sector gear 12*b*. The projection end of the shaft 7*c* of the cam means 7 has a pinion 13 secured thereto which meshes with the sector gear 12*b*.

Figure 3:
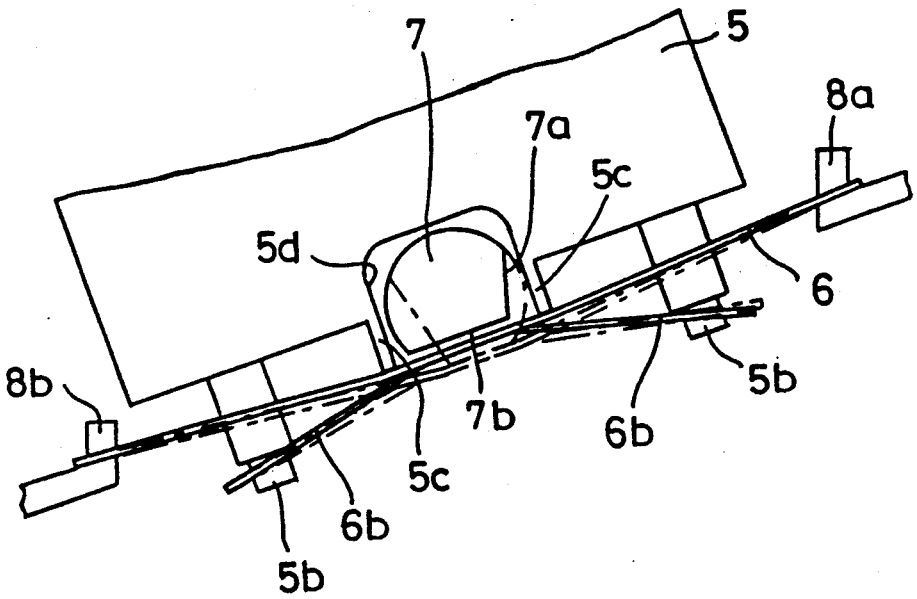
FIG. 3 is an enlarged front view showing the switching between the friction feed mode and a tractor feed mode.

In the friction feed mode, the operation lever 12 is at the solid line position in FIG. 2 and the cam means 7 is at its second rotational position. In this state, the second cam surface 7*b* of the cam means 7 is spaced from the biasing spring 6 so that they are out of engagement. Therefore, as illustrated by the solid lines in FIGS. 1 and 3, the contacting portions 5*c* are in contact with the biasing spring 6, and the spring force of the biasing spring 6 is applied via the supporting member 5 to the friction rollers 4. That is, upon receiving the strong spring force of the whole biasing spring 6, the friction rollers 4 strongly press the recording paper P against the platen 1, thereby attaining a friction feed operation.

If the tractor feed mode is selected, the operating portion 12*a* is controlled to swing the operation lever 12 counterclockwise to the chain line position in FIG. 2. In response to this swinging, the pinion 13 is rotated clockwise via the sector gear 12*b*, the cam means 7 is also rotated clockwise to the first rotational position, and the first cam surface 7*a* comes into engagement with the biasing spring 6 as illustrated by chain lines in FIG. 3. Since the biasing spring 6 is pushed down and deflected by the first cam surface 7*a*, the contacting portions 5*c* separate from the biasing spring 6. As a result, the supporting member 5 is pushed by the spring force of only the tongue portions 6*b* of the biasing spring 6, so that the friction rollers 4 contact resiliently with the platen 1 with a weak force. That is, since the spring force of the tongue portions 6*b* is weaker than that of the whole biasing spring 6, the friction rollers 4 in the tractor feed mode resiliently press the recording paper P against the platen 1 with a weaker spring force than in the case of the friction feed mode so that the recording paper P is fed with a moderate tensile force.

Although in the illustrated embodiment the length of the leg portions 5*b* is longer than the length of the contacting portions 5*c* and the tongue portions 6*b* for receiving the leg portions 5*b* lie in the same plane as that of the biasing spring 6, the length of the contacting portions 5*c* may be made longer than the length of the leg portions 5*b*, and in this case, the tongue portions 6*b* are received by the leg portions 5*b* after being bent toward the supporting member 5.

As described above, according to the paper feed device for a printer of the present invention, the pressing force of the friction rollers against the platen is changed in response to the switching between the tractor feed mode and the friction feed mode; therefore, the frictional force between the recording paper and the platen can be set to a proper level depending on the mode of paper feed. Further, the device can be readily assembled by stretching the biasing spring, and successively mounting the supporting member and the friction rollers. Further, the cost of the device can be reduced because the parts, such as biasing spring and supporting member, are simplified in configuration, the number of parts is small, and the structure of the device is simple.

Although the present invention has been described through specific terms, it should be noted here that the described embodiment is not necessarily exclusive and that various changes and modifications may be imparted thereto without departing from the scope of the invention which is limited solely by the appended claim.

What we claim is:

1. A paper feed for a printer comprising:

a frame means;

a platen rotatably mounted on said frame means;

friction roller support means juxtaposed to said platen;

biasing means mounted on said frame means and having a first operable condition biasing said friction roller support means toward said platen with a first biasing force and having a second operable condition biasing said friction roller support means toward said platen with a second biasing force less than said first biasing force;

cam means rotatably mounted on said frame means and operable between first and second operable positions to effect disposition of said biasing means in said first and second operating conditions;

said biasing means comprising a leaf spring having ends mounted on said frame means, said leaf spring having a main portion extending between said ends, said main portion engaging said friction roller support means when said cam means is in said first operable position such that said main portion of said spring biases said friction roller support means toward said platen;

said leaf spring having generally U-shaped tongue portions joined to said main portion, said tongue portions engaging said friction roller support means and being operable to bias said friction roller support means towards said platen;

said cam means being rotatably from said first to said second operable position to engage said main portion of said spring to space said main portion from said friction roller support means such that said main portion of said leaf spring no longer biases said friction roller support means towards said platen, said tongue portions biasing said friction roller support means toward said platen when said cam means is in said second operable position.

2. A paper feed according to claim 1, wherein the biasing force of said main portion of said spring is greater than the biasing force of said tongue portions.

3. A paper feed according to claim 1, wherein said spring has a central part substantially midway between said ends, said cam means being operable to engage said central part when said cam means is in said second operable position.

4. A paper feed according to claim 1, wherein said friction roller support means comprises a support member rotatably supporting at least one friction roller, said support member having a central portion having a recess, said cam means being disposed in said recess.

5. A paper feed according to claim 4, wherein said support member has extending parts disposed on either side of said recess and engageable with said spring when said cam means is in said first operable position.

6. A paper feed for a printer comprising:

a frame means;

a platen rotatably mounted on said frame means;

friction roller support means juxtaposed to said platen;

biasing means mounted on said frame means and having a first operable condition biasing said friction roller support means toward said platen with a first biasing force and having a second operable condition biasing said friction roller support means toward said platen with a second biasing force less than said first biasing force;

cam means rotatably mounted on said frame means and operable between first and second operable positions to effect disposition of said biasing means in said first and second operating conditions;

said biasing means comprising a leaf spring having a main portion and generally U-shaped tongue portions, said main portion of said spring biasing said friction roller support means toward said platen when said cam means is in said first operable position, said tongue portions biasing said friction roller support means toward said platen when said cam means is in said second operable position;

said friction roller support means comprising a support member rotatably supporting at least one friction roller, said support member having a central portion having a recess, said cam means being disposed in said recess;

said support member having projections engageable with said tongue portions, said tongue portions being disposed at an acute angle relative to the general plane of said leaf spring to thereby define openings in said main portion of said leaf spring, each of said tongue portions being superimposed relative to one of said openings, said projections extending through said openings.

7. A paper feed for a printer comprising:

a frame means;

a platen rotatably mounted on said frame means;

friction roller support means juxtaposed to said platen;

biasing means mounted on said frame means and having a first operable condition biasing said friction roller support means toward said platen with a first biasing force and having a second operable condition biasing said friction roller support means toward said platen with a second biasing force less than said first biasing force; and cam means rotatably mounted on said frame means and operable between first and second operable positions to effect disposition of said biasing means in said first and second operating conditions;

said biasing means comprising a leaf spring having a main portion and generally U-shaped tongue portions, said main portion of said spring biasing said friction roller support means toward said platen when said cam means is in said first operable position, said tongue portions biasing said friction roller support means toward said platen when said cam means is in said second operable position;

said friction roller support means having projections engageable with said tongue portions, said tongue portions being disposed at an acute angle relative to the general plane of said leaf spring to thereby define openings in said main portion of said leaf spring, each of said tongue portions being superimposed relative to one of said openings, said projections extending through said openings.

8. A paper feed according to claim 1 further comprising a platen shaft for rotatably supporting said platen and a cam shaft for rotatably supporting said cam means, and actuating means operably connected between said platen shaft and said cam shaft for actuating said cam means between said first and second operable positions.

9. A paper feed according to claim 8, wherein said actuating means comprises a first gear means rotatably mounted on said platen shaft and a second gear means mounted on said cam shaft, said first gear means being in mesh with said second gear means.

10. A paper feed according to claim 9, wherein said actuating means further comprises an actuating member connected to said first gear means and movable between a first and second actuating position, said first gear means being rotated as said actuating member is moved between said first and second actuating positions.

11. A paper feed according to claim 10 further comprising tractor feed means juxtaposed to said platen, said tractor feed means being operable to feed paper when said actuating member is in said second actuating position, said friction roller support means being operable to feed said paper when said actuating member is in said first actuating position.

* * * * *